US011292643B2

(12) United States Patent
Buzzi

(10) Patent No.: US 11,292,643 B2
(45) Date of Patent: Apr. 5, 2022

(54) CLOSURE FOR A SPOUT OF A FLEXIBLE THIN-WALLED PACKAGE

(71) Applicant: GUALA PACK S.P.A., Castellazzo Bormida (IT)

(72) Inventor: Alberto Buzzi, Castellazzo Bormida (IT)

(73) Assignee: GUALA PACK S.P.A., Castellazzo Bormida (IT)

( * ) Notice: Subject to any disclaimer, the term of this patent is extended or adjusted under 35 U.S.C. 154(b) by 0 days.

(21) Appl. No.: 17/290,011

(22) PCT Filed: Oct. 16, 2019

(86) PCT No.: PCT/IB2019/058803

§ 371 (c)(1),
(2) Date: Apr. 29, 2021

(87) PCT Pub. No.: WO2020/089721

PCT Pub. Date: May 7, 2020

(65) Prior Publication Data

US 2022/0002040 A1 Jan. 6, 2022

(30) Foreign Application Priority Data

Oct. 31, 2018 (IT) ..... 102018000009967

(51) Int. Cl.
*B65D 47/14* (2006.01)
*B65D 55/16* (2006.01)
*B65D 75/58* (2006.01)

(52) U.S. Cl.
CPC ..... *B65D 47/143* (2013.01); *B65D 55/16* (2013.01); *B65D 75/5883* (2013.01)

(58) Field of Classification Search
CPC .... B65D 47/143; B65D 47/14; B65D 47/142; B65D 55/16; B65D 75/5883
See application file for complete search history.

(56) References Cited

U.S. PATENT DOCUMENTS 2,911,128 A * 11/1959 Krautkramer ..... B65D 47/14 222/543
3,059,816 A * 10/1962 Goldstein ..... B65D 47/0842 222/109

(Continued)

FOREIGN PATENT DOCUMENTS

JP 2006096416 A 4/2006
JP 2007204124 A 8/2007

(Continued)

OTHER PUBLICATIONS

International Search Report for International Patent Application No. PCT/IB2019/058803, dated Jan. 2, 2020, 2 pages.

*Primary Examiner* — Donnell A Long
(74) *Attorney, Agent, or Firm* — Armstrong Teasdale LLP

(57) ABSTRACT

A closure for a spout has a closure body having an annular body wall extending along a main axis between a closure base and an annular body wall edge. The closure is screwable to a spout having a connecting portion, suitable for welding to thin walls of a package, and a tube protruding from the connecting portion along a spout axis and ending with a mouth. The tube has a gripping section having a guide ring. Connection means connect the closure to the spout even when the closure is unscrewed. The connection means have a collar inserted on the gripping section of the spout and axially bound thereto by the guide ring, and an at least partially flexible tie that joins the collar to the closure.

13 Claims, 8 Drawing Sheets

(56) References Cited

U.S. PATENT DOCUMENTS 3,192,555 A * 7/1965 Nyden ..... B43M 11/06 401/139
3,744,675 A * 7/1973 Song ..... B65D 47/14 222/153.14
3,758,000 A * 9/1973 Mack ..... B65D 50/045 222/143
3,811,592 A * 5/1974 Dye ..... B65D 47/14 215/307
5,711,453 A * 1/1998 Weiler ..... B65D 47/14 222/541.2
9,016,505 B2 * 4/2015 Canegallo ..... B65D 75/5866 220/277
2002/0179614 A1 * 12/2002 Rohlfs ..... B65D 43/00 220/713
2006/0201967 A1 * 9/2006 Romer ..... B65D 75/5883 222/92
2008/0073348 A1 * 3/2008 Pritikin ..... B65D 51/225 220/278
2015/0144632 A1 * 5/2015 Tamarindo ..... B65D 41/3404 220/265
2016/0122095 A1 * 5/2016 Berge ..... B65D 75/008 222/92
2016/0145025 A1 * 5/2016 Van Der Molen ..... B65B 1/02 222/107
2017/0107023 A1 * 4/2017 Miksovsky ..... B65D 55/16
2018/0201415 A1 * 7/2018 Berge ..... B65D 75/5883
2018/0265259 A1 * 9/2018 Berge ..... A61L 2/02
2018/0346219 A1 * 12/2018 Murray ..... B65B 3/045
2019/0075973 A1 * 3/2019 Charleson ..... B65D 47/142
2019/0119024 A1 * 4/2019 Tamarindo ..... B65D 77/065
2019/0168924 A1 * 6/2019 Tamarindo ..... B65D 47/122
2020/0307886 A1 * 10/2020 Tamarindo ..... B65D 47/061
2021/0002045 A1 * 1/2021 Lin ..... B65D 47/122
2021/0039847 A1 * 2/2021 Umenaka ..... B65D 41/47

FOREIGN PATENT DOCUMENTS

KR 20180109233 A 10/2018
WO 2018020365 A1 2/2018

* cited by examiner

CLOSURE FOR A SPOUT OF A FLEXIBLE THIN-WALLED PACKAGE

CROSS-REFERENCE TO RELATED APPLICATIONS

This application is a National Stage Application of International Patent Application No. PCT/IB2019/058803, having an International Filing Date of Oct. 16, 2019, which claims the benefit of priority to Italian Patent Application No. 102018000009967, filed Oct. 31, 2018, the entire contents of which are hereby incorporated by reference herein.

FIELD OF THE INVENTION

The subject-matter of the present invention is a closure for a spout of a flexible thin-walled package, usually referred to as a "pouch".

BACKGROUND OF THE INVENTION

As is well known, these packages are widely used to contain products such as fruit juices and purees, yogurts, energy drinks and the like.

They are particularly appreciated for their enormous ease of use, as the spout allows the product to be dispensed directly into the mouth, and, as far as children's products are concerned, for the play component inherent in the use of the spout.

Usually, the package comprises a cap screwed to the spout, provided with a guarantee seal that indicates the first use.

Once the cap has been unscrewed from the spout, it remains in the user's hand, usually in the other hand than the one used for drinking, or, in the case of children, it is handed over to the person accompanying the child. Being uncomfortable to hold and given the small size, the risk is that the cap will be thrown away at the first opportunity or that it will be lost, without taking into account the proper disposal thereof.

SUMMARY OF THE INVENTION

The object of the present invention is to create a closure for a spout of a flexible thin-walled package that satisfies the needs of the sector and overcomes the drawbacks mentioned with reference to the prior art.

This object is achieved by a closure as described and claimed herein. Advantageous embodiments are also described.

BRIEF DESCRIPTION OF THE DRAWINGS

The features and advantages of the closure according to the present invention will be apparent from the description given hereinafter, provided by way of non-limiting example, in accordance with the accompanying figures, wherein.

DETAILED DESCRIPTION

Figure 1B:
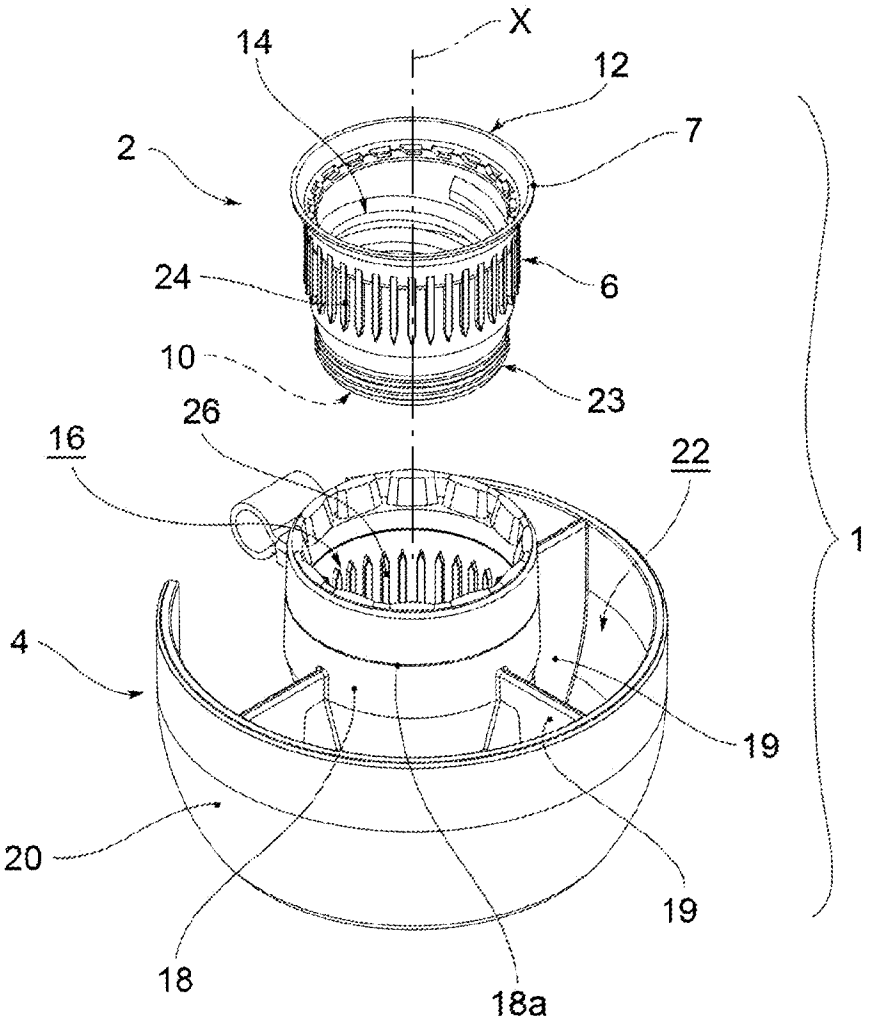
FIG. 1*b* shows the closure of FIG. 1*a* with the parts separated.
Figure 1A:
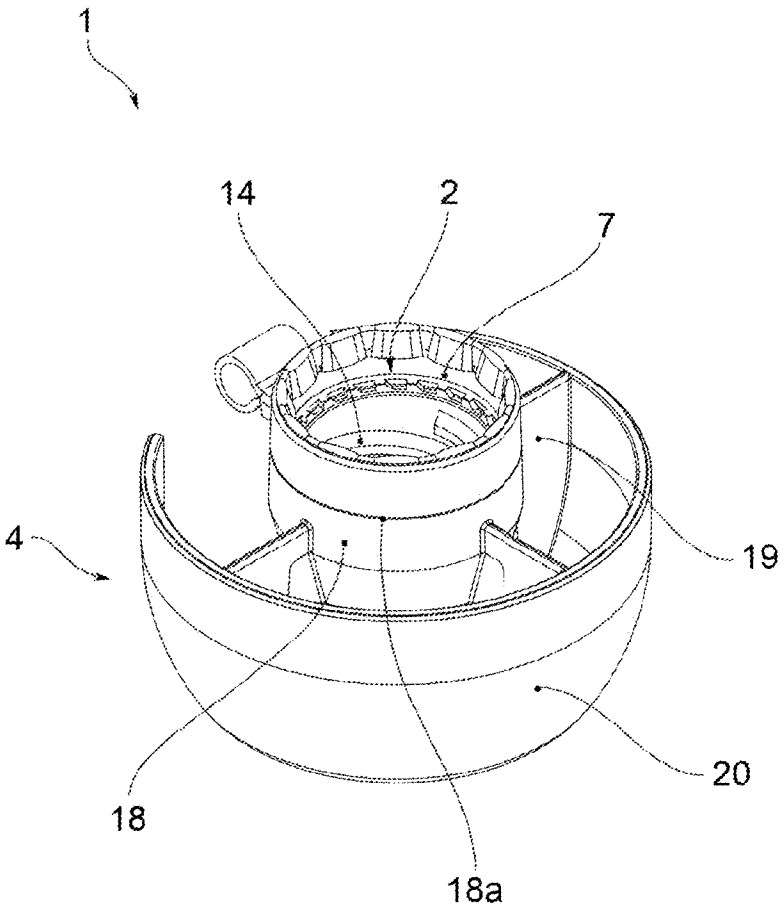
FIG. 1*a* shows a closure according to an embodiment of the present invention, with the parts joined.

With reference to the accompanying figures, a closure for a spout of a flexible thin-walled package according to an embodiment of the present invention is indicated collectively at 1.

Preferably, the closure 1 comprises a closure body 2 and a cap cover 4, to which the closure body 2 is permanently applicable.

The closure body 2 comprises an annular wall body 6 having a main axis X and a predefined height along said main axis X; the body wall 6 extends between a closure base 10 and an annular body wall edge 7 for the insertion of the closure body 2 on the spout.

The body wall 6 is internally threaded (thread 14) for screwing to the spout.

According to a preferred embodiment, the cap cover 4 comprises a closure compartment 16, for example delimited by an annular cap cover wall 18, suitable to accommodate the closure body 2.

The cap cover wall 18 extends axially between a cap cover wall edge 18*a* and a cap cover base 18*b* which serves as a closure.

Preferably, the cap cover 4 comprises a plurality of tabs 19, protruding radially from the outside of the cap cover wall 18, and a gripping wall 20, annular or annular in sections, made integral to the cap cover wall 18 by said tabs.

By virtue of the tabs 19, the gripping wall 20 is radially spaced from the cap cover wall 18, forming axial anti-suffocation passages 22.

Preferably, the closure body 2 is accommodated in the closure compartment 16 so that it is bound axially and rotationally.

For example, the body wall 6 of the closure body 2 has a plurality of axial ribs 24 protruding outwards, while the cap cover wall 18 has internally a corresponding plurality of axial recesses 26, each recess being suitable to accommodate the respective rib, thus creating a relative rotational constraint.

Moreover, near the closure base 10, the closure body further comprises small rings 23 that engage in the closure compartment 16 near respective grooves close to the cap cover base 18*b* to achieve a relative axial constraint.

The spout-closure assembly has an engaged configuration, wherein the closure is screwed to the spout, and a disengaged configuration, wherein the closure is unscrewed from the spout.

According to the invention, suitable connection means are provided to keep the closure 1 connected to the spout also in the disengaged configuration, i.e., after having unscrewed the closure from the spout.

According to an embodiment, said connection means comprise a collar 30 suitable for insertion onto a section of the spout, and a flexible tie 32 connecting the collar 30 to the closure 1, for example to the cap cover wall 18 of the cap cover 4 (as in the example shown in the figures) or to the closure wall of the closure body (example not shown).

For example, the tie 32 is shaped like a flat band.

According to an embodiment, moreover, in a resting condition of the connection means, the tie 32 comprises a closure-side portion 34, for example flat, joined to the cap cover wall 18, a spout-side portion 36, for example flat, joined to the collar 30, and an arched intermediate portion 38, which joins the closure-side portion 34 and the spout-side portion 36, for example flat.

Advantageously, this embodiment allows the collar to be sufficiently spaced from the closure, so as to be able to unscrew and remove the closure from the spout.

Figure 12A:
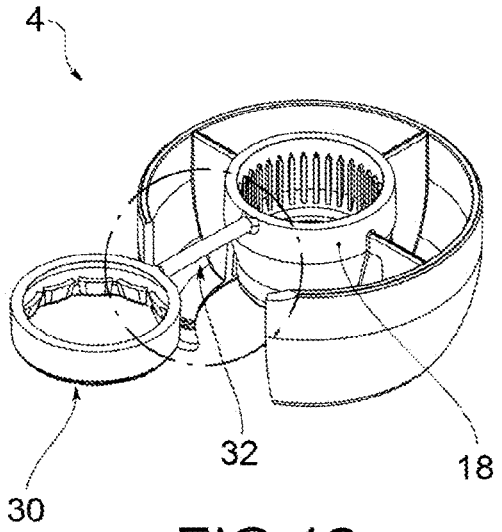
FIGS. 12*a* and 12*b* illustrate a cap cover of the closure according to a further embodiment of the invention and a corresponding enlargement, in a disengaged configuration.
Figure 13A:
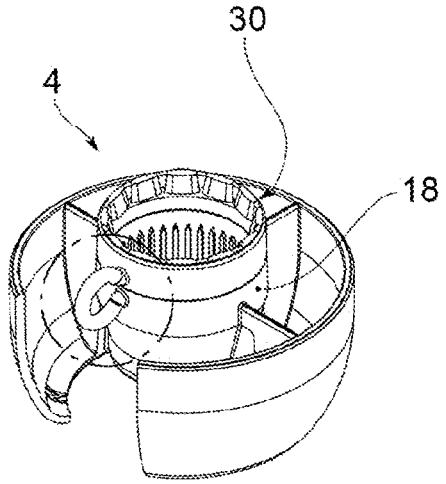
FIGS. 13*a* and 13*b* illustrate the cap cover of FIGS. 12*a* and 12*b*, in an engaged configuration.
Figure 12B:
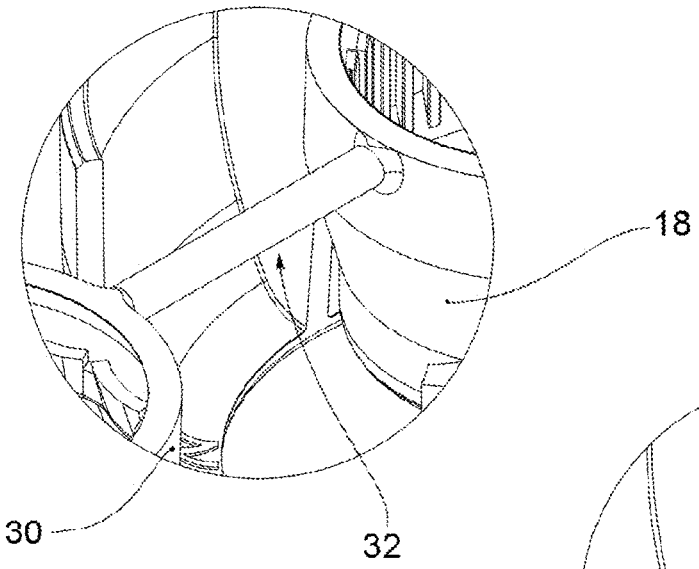
Figure 13B:
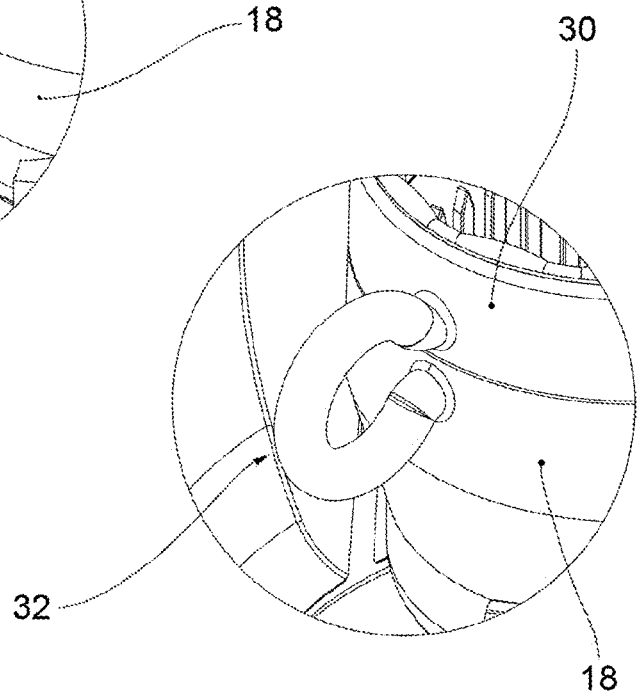

According to a further embodiment (FIGS. 12*a*, 12*b*; 13*a*, 13*b*), the tie 32 has a round section, preferably without dimensional variations.

Figure 4:
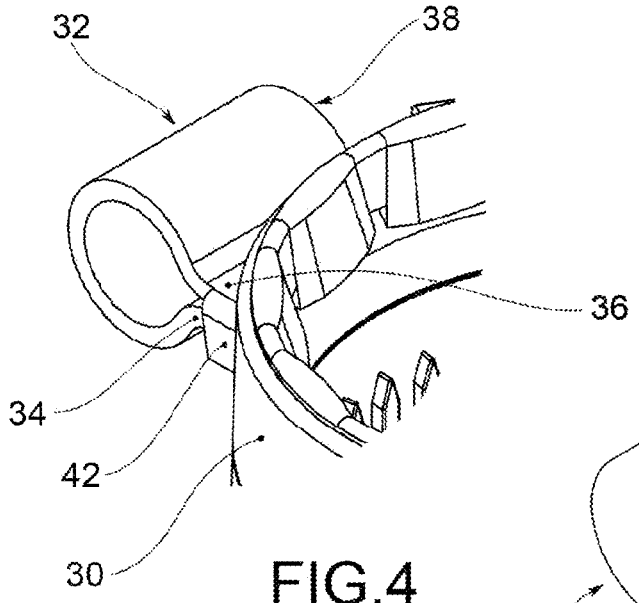
Figure 5:
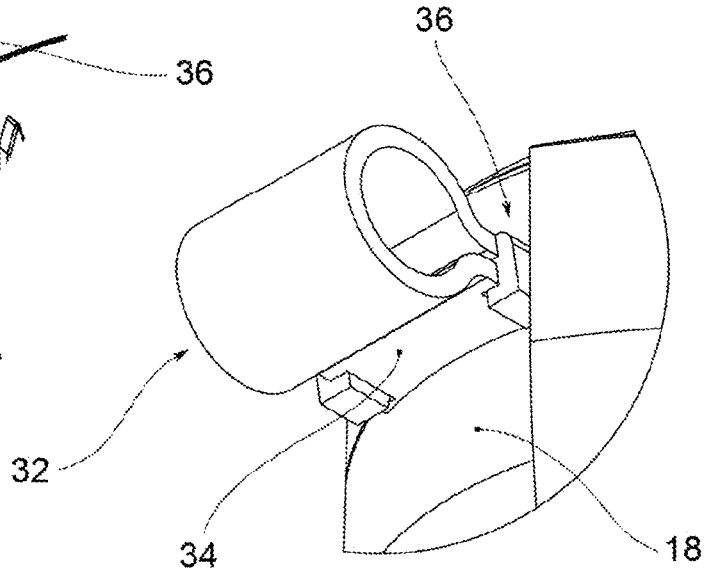

In the engaged configuration, the collar 30 is superimposed on the cap cover wall 18, for example, coaxially, for example in abutment with the cap cover wall edge 18*a*, and the tie 32 is bent so that the spout-side portion 36 is superimposed on the closure-side portion 34 and the intermediate portion 38 is deformed, typically assuming an arched shape (FIGS. 4 and 5).

The connection means comprise alignment means suitable for circumferentially binding the spout-side portion 36 of the tie 32 to the closure-side portion 34 in the engaged configuration.

For example, these alignment means comprise a pair of binding elements 42, 44, for example, protruding from the spout-side portion, placed on the sides thereof and configured to accommodate at least one section of the closed-side portion in the engaged configuration (FIG. 4). Consequently, the closure-side portion 34 and the spout-side portion 36 are bound circumferentially and cannot, for example, warp each other due to relative movements between the collar and the closure.

Preferably, said binding elements are configured to create a snap engagement with the closure-side portion.

Figure 6:
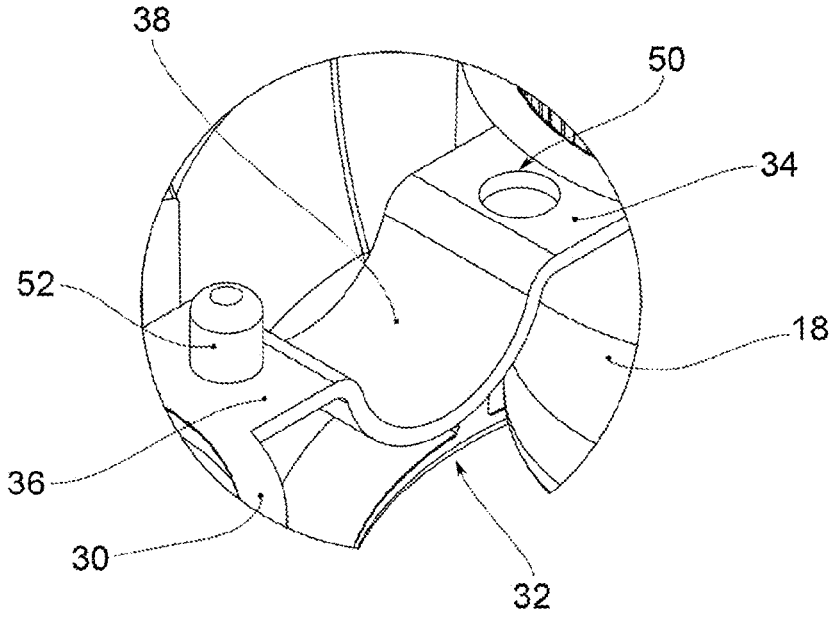
FIGS. 6, 7 and 8 illustrate enlargements of a further embodiment.
Figure 7:
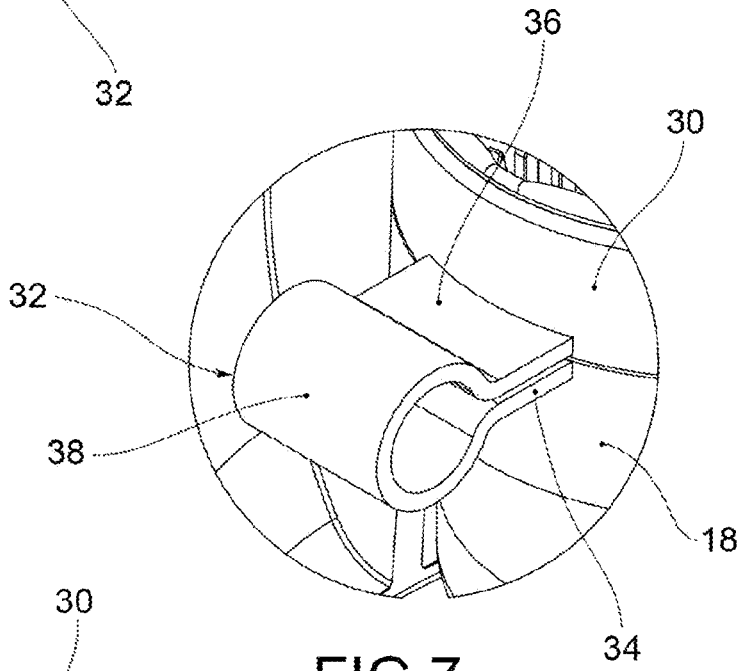
Figure 8:
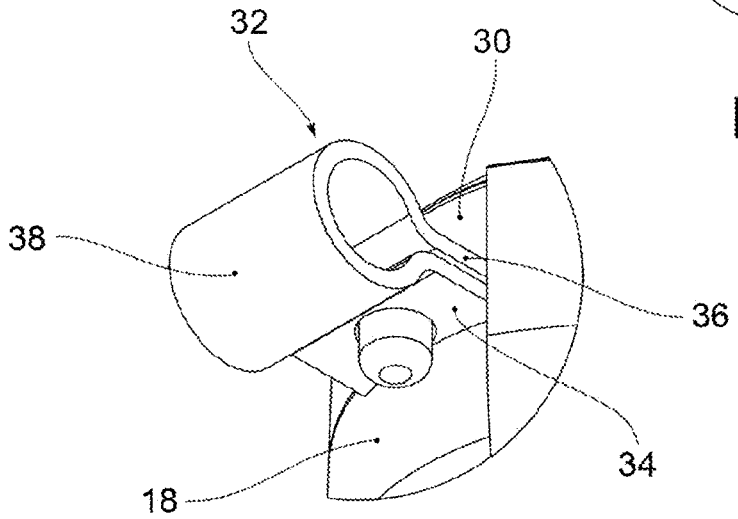

According to a further example embodiment (FIGS. 6, 7 and 8), the alignment means comprise a hole 50, for example, a through-hole, made through the thickness of the closure-side portion 34 and a peg 52 protruding from the collar side portion 36, suitable to be inserted into the hole 50.

In the engaged configuration, the peg 52 is in the hole 50 and prevents circumferential warping between the collar and the closure.

Figure 2A:
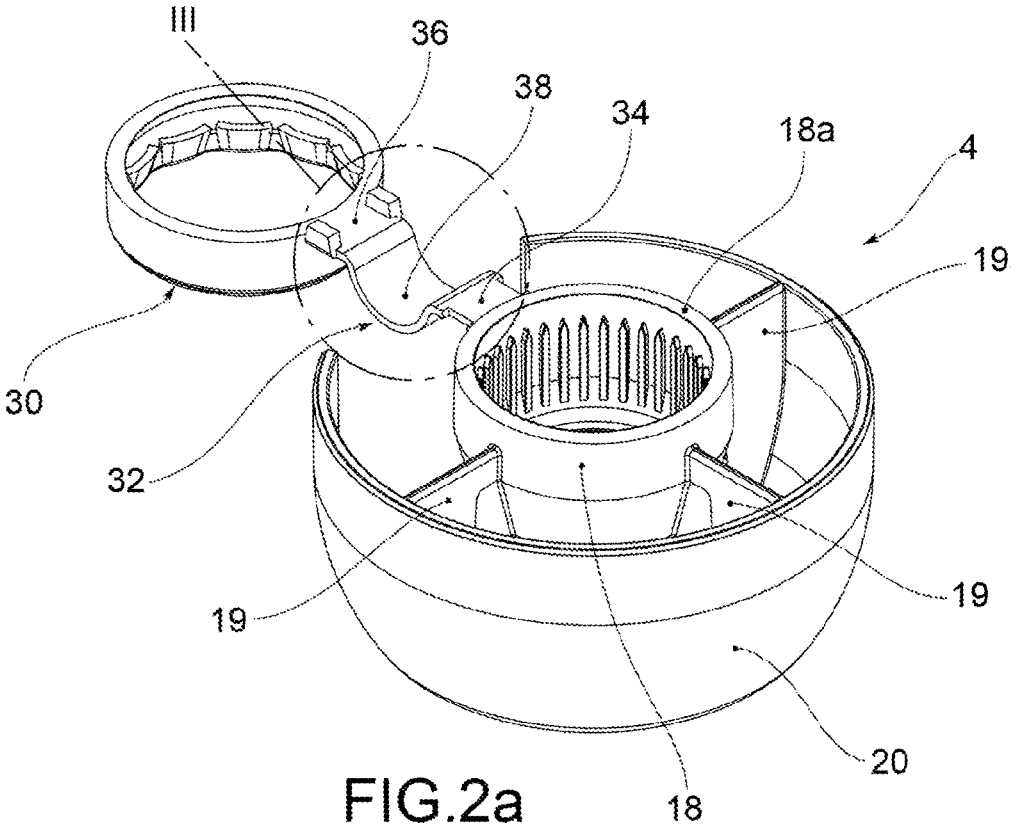
FIGS. 2*a*, 2*b* and 2*c* represent a cap cover of the closure according to the present invention, in a disengaged configuration, in an engaged configuration and in a engaged configuration according to a further perspective.
Figure 2B:
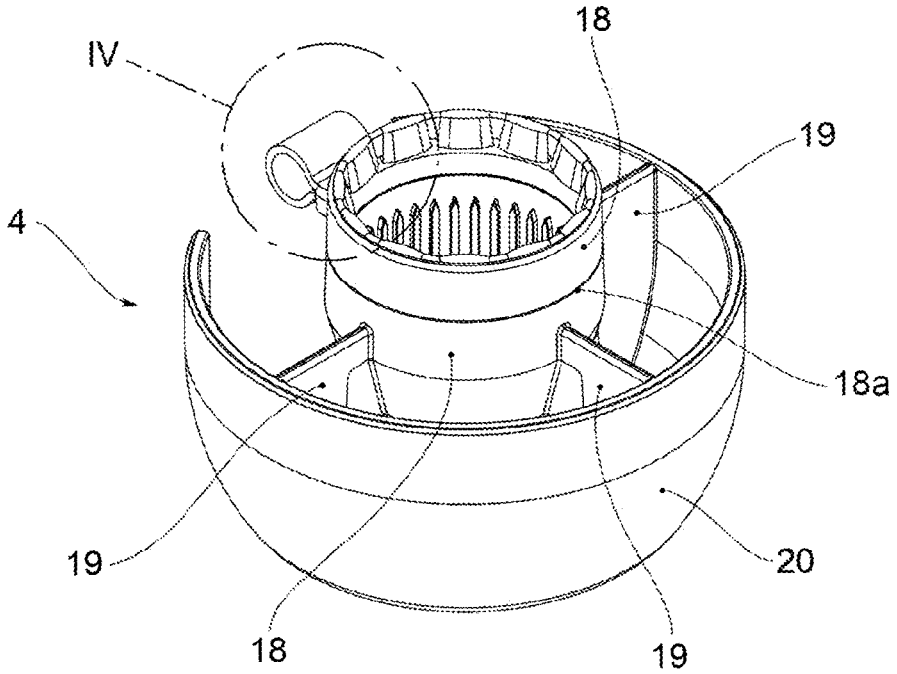
Figure 2C:
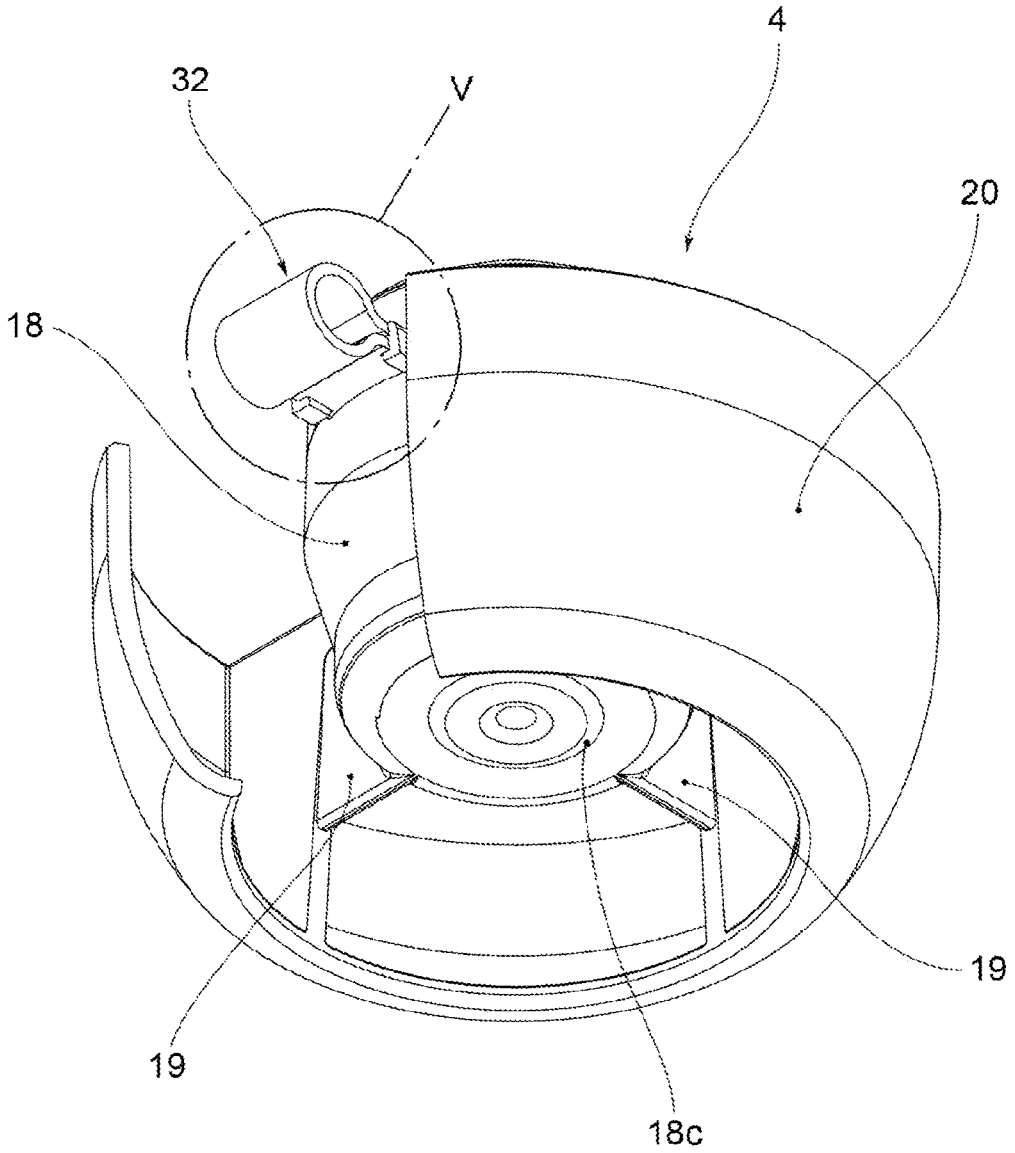
Figure 3:
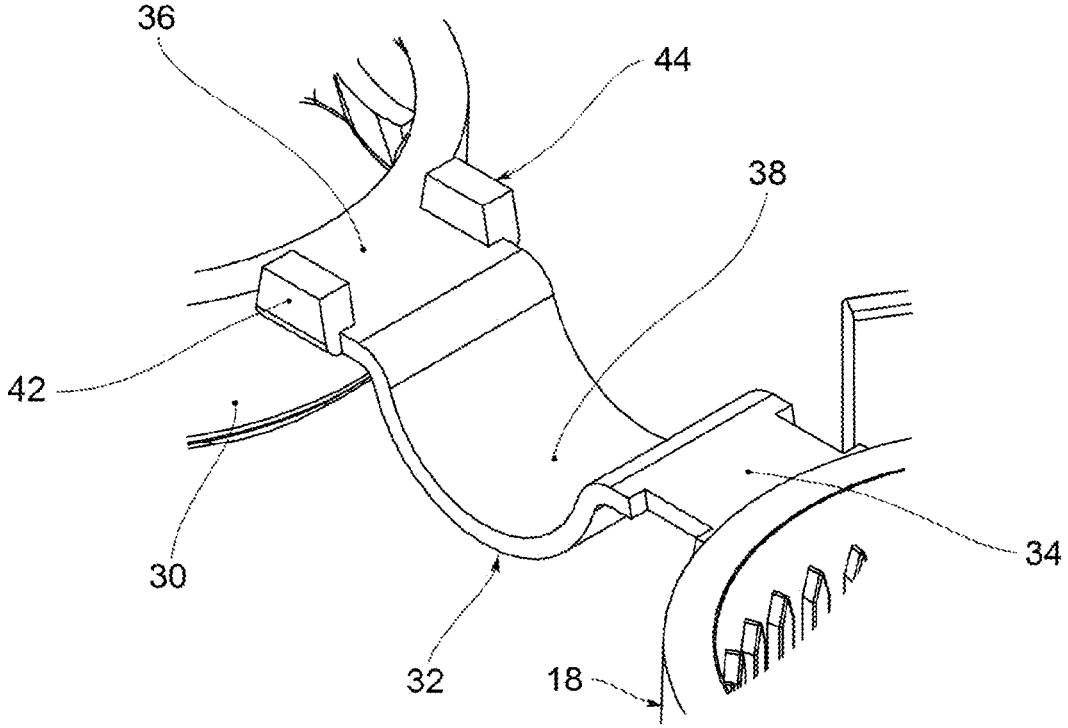
FIGS. 3, 4 and 5 respectively illustrate an enlargement of boxes III, IV and V in FIGS. 2*a*, 2*b* and 2*c;*

A manufacturing method according to the present invention provides for making the cap cover 4, the tie 32 and the collar 30 in a single piece of plastic material, in an open configuration corresponding to the representation in FIG. 2*a*; subsequently, the collar is superimposed on the cap cover wall 18, reaching a closed configuration corresponding to the representation in FIG. 2*b*. The closure body 2 is then inserted into the closure compartment 16, so that the body wall edge 7 is contained within the collar 30.

Figure 9:
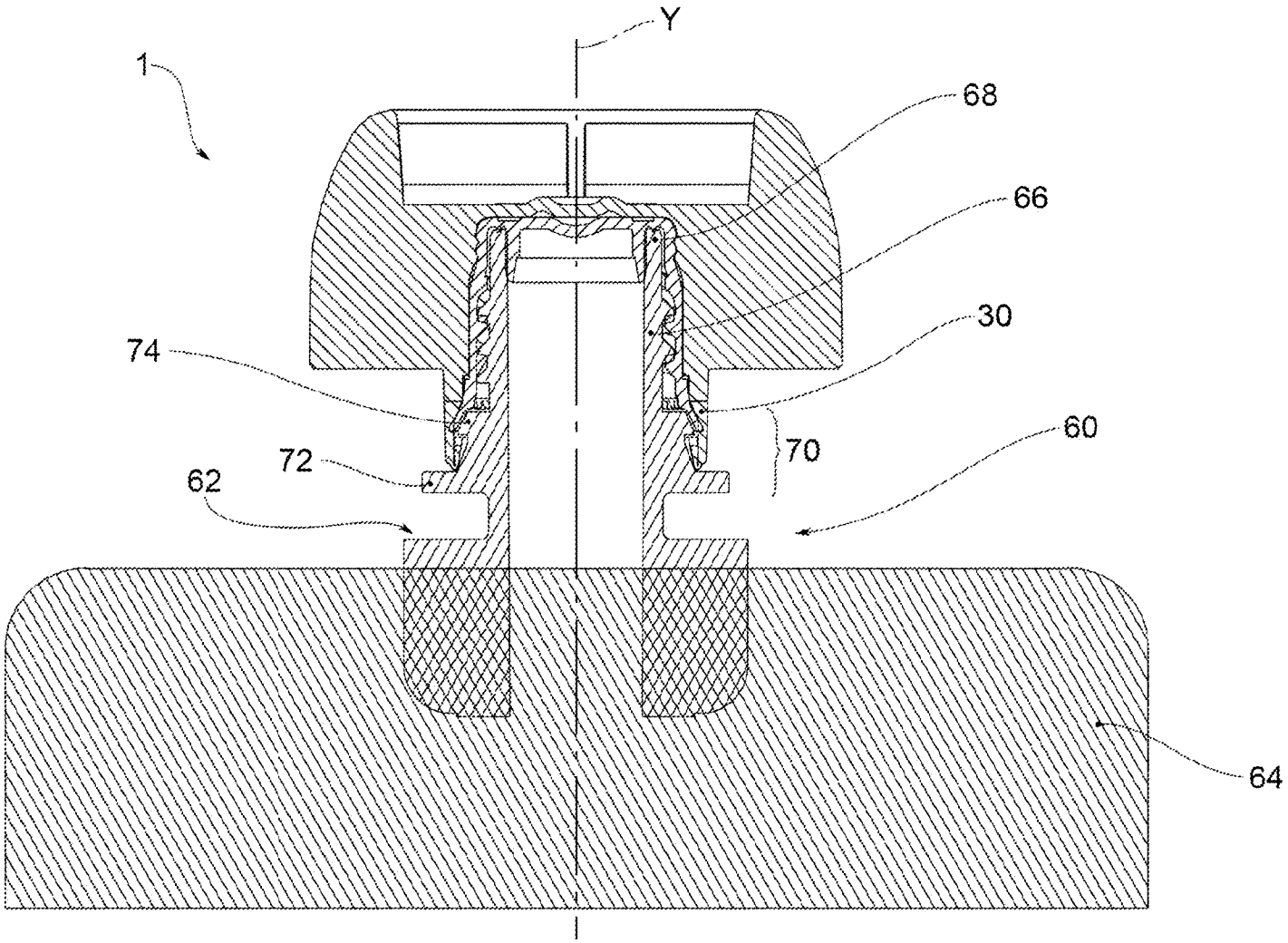
FIG. 9 represents a sectional view of an assembly comprising a spout and a closure according to the present invention.

Preferably (FIG. 9), a spout 60 comprises a connection portion 62, usually referred to as a "welding boat", suitable for welding to the thin walls 64 of the package, and a tube 66 protruding from the connection portion 62 along a spout axis Y, ending with a mouth 68 of the spout 60.

Along the tube 66, from the connection portion 62 to the mouth 68, the spout 60 comprises a gripping section for the engagement with the collar 30 of the connection means.

For example, said gripping section 70 is delimited by a lower plate 72 and a guide ring 74, preferably beveled to make a guide for the snap-engagement of the collar 30.

For the first application to the spout, the process provides for, starting from the aforesaid closed configuration, a first step wherein the closure 1 is applied to the spout 60 and forcibly screwed thereto, so that the collar 30 snap-engages with the gripping section 70 of the spout 60.

When screwing, the closure and the collar tend to rotate relatively, due to the screwing action on the closure and the frictional forces between spout and collar acting on the collar. In this step, the alignment means prevent the closure-side portion of the tie from misaligning angularly from the spout-side portion.

Said alignment means are therefore particularly advantageous during the initial application of the closure to the spout.

In normal use of the package, the closure 1 is held by the user and unscrewed from the spout; the collar 30 remains connected to the spout and, by means of the tie 32, allows the closure to be kept connected to the spout.

The assembly consisting of the closure body 2, the cap cover 4, the spout 60 and the collar 30 creates a guarantee seal, the structure and functionality of which is described in the International Application WO-A1-2018/020365 in the name of the Applicant. The teaching contained therein in relation to this guarantee seal is hereby expressly incorporated.

In particular, according to the International Application WO-A1-2018/020365, the collar forms the fixed band of the guarantee seal, the base edge of the closure body forms the guarantee ring and the cap cover wall forms the movable body.

When unscrewing the closure, the closure 1 axially separates from the collar 30 and the body wall edge 7 of the closure body 2 emerges from the collar 30, widening toward the outside.

Figure 11:
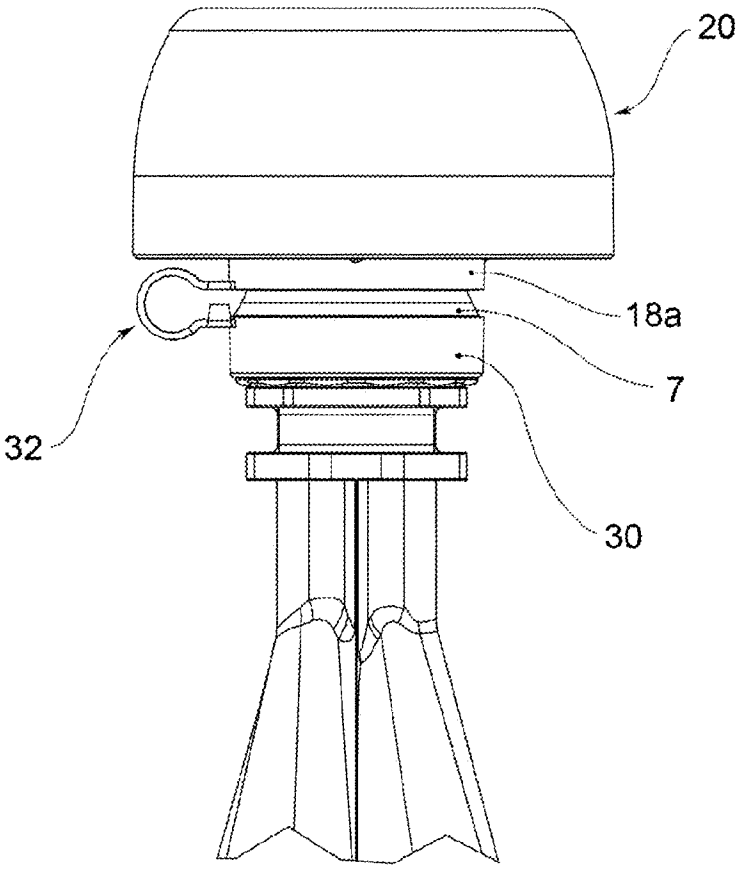
FIGS. 10 and 11 illustrate the spout-closure assembly according to the present invention, respectively in a condition with the guarantee seal unbroken and broken.
Figure 10:
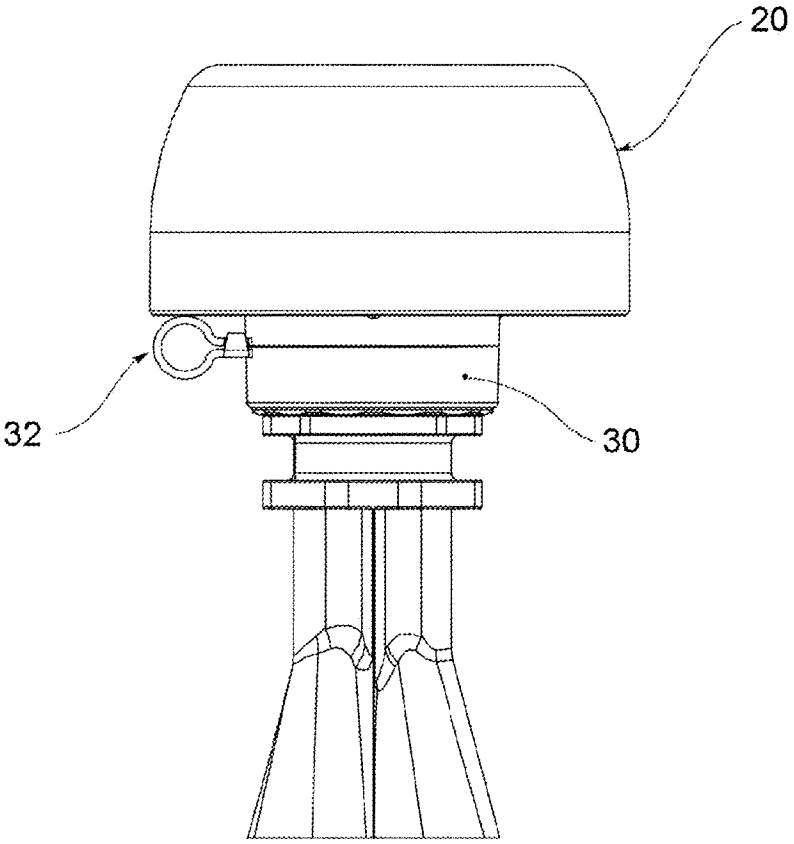

In this way, by screwing the closure to the spout, the body wall edge 7 is placed between the cover cap wall edge 18*a* and the collar 30, preventing the mutual contact thereof, and shows if the package has been opened (FIG. 11).

According to a preferred embodiment, in the position wherein the tie 32 is connected to the cap cover wall 18, the gripping wall 20 of the cap cover 4 is interrupted by a predefined angular width.

This allows the closure to be made in a single piece of plastic material, without the use of complex molds with movable parts.

Innovatively, the closure according to the present invention allows the needs of the sector to be satisfied and to overcome the drawbacks mentioned above, as the closure remains connected to the spout even after opening the package.

It is apparent that one skilled in the art, in order to meet contingent needs and specifications, may make changes to the closure described above, all contained within the scope of protection as defined by the following claims.

The invention claimed is:

1. A closure assembly for a flexible thin-walled package, the closure assembly comprising:

a closure comprising a closure body, wherein the closure body comprises an annular body wall extending along a main axis between a closure base and an annular body wall edge;

a spout comprising a connecting portion, suitable for welding to thin walls of the package, and a tube protruding from the connecting portion along a spout axis and ending with a mouth, wherein the tube comprises a gripping section having a guide ring and wherein the closure is screwable and unscrewable from the spout; and connection means suitable for connecting the closure to the spout even when the closure is unscrewed from said spout, said connection means comprising a collar, inserted on the gripping section of the spout and axially bound thereto by said guide ring, and an at least partially flexible tie that joins the collar to the closure;

wherein the at least partially flexible tie comprises a closure-side portion connected to the closure, said closure-side portion being non-deformable, a spout-side portion connected to the collar, said spout-side portion being non-deformable, and an intermediate flexible portion; and wherein said at least partially flexible tie comprises alignment means suitable for preventing a circumferential misalignment between the closure-side portion and the spout-side portion when said closure-side portion and said spout-side portion are superimposed.

2. The closure assembly of claim 1, wherein the collar is rotatable on the gripping section.

3. The closure assembly of claim 1, wherein, when the at least partially flexible tie is in a resting condition, the intermediate flexible portion is arched.

4. The closure assembly of claim 1, wherein said alignment means comprise a pair of binding elements protruding laterally from the spout-side portion, a section of the closure-side portion being arranged between said pair of binding elements when the closure-side portion is superimposed on the spout-side portion.

5. The closure assembly of claim 1, wherein said alignment means comprise a pair of binding elements protruding laterally from the closure-side portion, a section of the spout-side portion being arranged between said pair of binding elements when the spout-side portion is superimposed on the closure-side portion.

6. The closure assembly of claim 1, wherein said alignment means comprise a hole in the closure-side portion and a peg protruding from the spout-side portion, wherein the peg is inserted into the hole when the spout-side portion is superimposed on the closure-side portion.

7. The closure assembly of claim 1, wherein said alignment means comprise a hole in the spout-side portion and a peg protruding from the closure-side portion, wherein the peg is inserted into the hole when the closure-side portion is superimposed on the spout-side portion.

8. The closure assembly of claim 1, wherein the closure further comprises a cap cover, said cap cover comprising a closure compartment peripherally delimited by a cap cover wall having a cap cover wall edge, the closure body being predominantly housed in said closure compartment.

9. The closure assembly of claim 8, wherein, in an engaged configuration, the collar is superimposed coaxially and in contact with the cap cover wall edge of the cap cover wall and the annular body wall edge is contained in said collar.

10. The closure assembly of claim 9, wherein, in a disengaged configuration, the collar is spaced from the cap cover wall edge and the annular body wall edge is placed between said cap cover wall edge and the collar, preventing mutual contact thereof.

11. The closure assembly of claim 8, wherein the cap cover comprises an annular gripping wall, integral with the cap cover wall and radially spaced therefrom.

12. The closure assembly claim 11, wherein the closure comprises a plurality of tabs that join the annular gripping wall to the cap cover wall.

13. The assembly of claim 11, wherein the annular gripping wall is interrupted at the at least partially flexible tie.

* * * * *